US009907369B2

(12) United States Patent
Kelly et al.

(10) Patent No.: US 9,907,369 B2
(45) Date of Patent: Mar. 6, 2018

(54) ADJUSTABLE CARRYING PACK

(71) Applicant: Thule IP AB, Malmö (SE)

(72) Inventors: Damien Kelly, Squamish (CA); Graham Jackson, Boulder, CO (US)

(73) Assignee: Thule IP AB, Malmö (SE)

( * ) Notice: Subject to any disclaimer, the term of this patent is extended or adjusted under 35 U.S.C. 154(b) by 163 days.

(21) Appl. No.: 14/600,879

(22) Filed: Jan. 20, 2015

(65) Prior Publication Data

US 2016/0206052 A1 Jul. 21, 2016

(51) Int. Cl.

| | |
|---|---|
| ***A45F 3/04*** | (2006.01) |
| ***A44B 13/00*** | (2006.01) |
| ***A44B 11/28*** | (2006.01) |
| ***A45F 4/00*** | (2006.01) |
| ***A63C 11/02*** | (2006.01) |

(52) U.S. Cl.

CPC ..... *A44B 11/28* (2013.01); *A44B 13/0029* (2013.01); *A44B 13/0052* (2013.01); *A45F 3/04* (2013.01); *A45F 4/00* (2013.01); *A63C 11/025* (2013.01); *A45F 2003/045* (2013.01); *A45F 2200/0566* (2013.01)

(58) Field of Classification Search

CPC ..... Y10S 224/917; A45C 7/0086; A45C 13/1046; A45F 3/14; A45F 3/08; A45F 2003/142; A45F 2003/003; A63C 11/025; A63C 2203/44

USPC ..... 224/650–651, 578–580, 917, 913; 294/149, 150, 157; 248/693

See application file for complete search history.

(56) References Cited

U.S. PATENT DOCUMENTS

| | | | | |
|---|---|---|---|---|
| 4,518,107 A * | 5/1985 | Amos | A45F 3/04 224/153 |
| 4,982,883 A * | 1/1991 | Ullal | A45F 3/14 224/643 |
| 5,746,361 A * | 5/1998 | Johnson | A45F 3/14 224/245 |
| 5,803,332 A * | 9/1998 | Thompson | A45F 3/04 224/153 |
| 5,934,533 A | 8/1999 | Callanan | |

(Continued)

FOREIGN PATENT DOCUMENTS

| | | |
|---|---|---|
| WO | WO 2005/027678 | 3/2005 |
| WO | WO 2006/104368 | 10/2006 |

OTHER PUBLICATIONS

Osprey, "Kode 32—Ski & Snowboard: Osprey Packs," <http://www.ospreyeurope.com/gb_en/kode-32#.VL6vOfAo5D_>, accessed Sep. 24, 2014.

*Primary Examiner* — Adam Waggenspack

(74) *Attorney, Agent, or Firm* — Sterne, Kessler, Goldstein & Fox P.L.L.C.

(57) ABSTRACT

An adjustable carrying pack includes a main body having an outer surface with an upper portion, a lower portion, and a rear portion. A first strap having a plurality of loops is disposed along a first side of the outer surface of the main body and a second strap having a plurality of loops is disposed along a second side of the outer surface of the main body. A bottom strap includes a fixed end and a free end having an attachment element. In a first configuration, the attachment element of the bottom strap is attached to a loop of the first strap. In a second configuration, the attachment element of the bottom strap is attached to a loop of the second strap.

22 Claims, 11 Drawing Sheets

(56) References Cited

U.S. PATENT DOCUMENTS

| | | | | |
|---|---|---|---|---|
| 6,123,239 | A * | 9/2000 | Lovitt | B62J 9/00 190/103 |
| 6,135,334 | A * | 10/2000 | Seichter | A45F 3/08 224/250 |
| 6,179,175 | B1 * | 1/2001 | Painter | A45F 3/08 224/153 |
| 8,746,523 | B1 * | 6/2014 | Woolley | A45C 13/30 224/578 |
| 2002/0038811 | A1 * | 4/2002 | Vigny | A45F 3/04 224/651 |
| 2003/0230701 | A1 * | 12/2003 | Chang | D04D 9/04 248/682 |
| 2005/0103817 | A1 * | 5/2005 | Glankler | A45C 7/0086 224/583 |
| 2010/0108730 | A1 | 5/2010 | Sabbah | |
| 2010/0206930 | A1 * | 8/2010 | Sims | A63C 11/025 224/607 |

* cited by examiner

ADJUSTABLE CARRYING PACK

BACKGROUND

Field

Embodiments of the present invention relate to bags and carrying packs. More specifically, embodiments of the present invention relate to adjustable bags and carrying packs for carrying equipment, for example, outdoor sports equipment such as skis and snowboards.

Background

Carrying packs, such as backpacks, are useful for storing and carrying equipment. Some carrying packs for outdoor sports are designed, for example, to carry skis or snowboards. Some packs include adjustable straps for carrying this equipment, but these designs are complex, cannot be adjusted quickly, and have numerous straps cluttering the outside of the pack even when not carrying equipment.

BRIEF SUMMARY

In certain embodiments, an adjustable carrying pack includes a main body having an outer surface with an upper portion, a lower portion, and a rear portion. The carrying pack can include a first strap having a plurality of loops disposed along a first side of the outer surface of the main body and a second strap having a plurality of loops disposed along a second side of the outer surface of the main body. In certain embodiments, the carrying pack can include a bottom strap having a fixed end and a free end having an attachment element. In certain embodiments, the fixed end can be attached on the second side of the lower portion of the main body. In certain embodiments, in a first configuration, the attachment element of the bottom strap can be attached to a loop of the first strap. In certain embodiments, in a second configuration, the attachment element of the bottom strap can be attached to a loop of the second strap. In certain embodiments, a loop formed by the bottom strap in the first configuration is larger than a loop formed by the bottom strap in the second configuration.

In certain embodiments, the adjustable carrying pack can also include a first passage disposed along the first side of the lower portion of the main body and a second passage disposed along the second side of the lower portion of the main body. In certain embodiments, in the first configuration, the bottom strap can pass through the first passage, and in the second configuration, the bottom strap can pass through the second passage. In certain embodiments, lower ends of the first and second straps can attach to the main body within the respective first and second passages.

In certain embodiments, the first and second straps can extend from the lower portion of the main body to the upper portion of the main body. In certain embodiments, the first and second straps are disposed along a lengthwise direction of the main body. In certain embodiments, the first and second straps are parallel. In certain embodiments, the first and second straps are disposed at an angle with respect to each other such that upper ends of the first and second straps are farther apart than lower ends of the first and second straps.

In certain embodiments, the carrying pack includes a first pocket disposed on the second side of the lower portion of the main body. In certain embodiments, in a storage configuration, the bottom strap can be disposed inside the first pocket. In certain embodiments, the fixed end of the bottom strap can be attached to the main body inside the first pocket.

In certain embodiments, the first pocket can be disposed at a lower end of the second passage.

In certain embodiments, the carrying pack includes a top strap having a fixed end and a free end having an attachment element, where the fixed end is attached on the first side of the upper portion of the main body. In certain embodiments, a first attachment point can be disposed on the first side of the upper portion of the main body and a second attachment point can be disposed on the second side of the upper portion of the main body. In certain embodiments, in a first configuration, the attachment element of the top strap can attach to the second attachment point. In certain embodiments, in a second configuration, the attachment element of the top strap can attach to the first attachment point.

In certain embodiments, the carrying pack can include a second pocket disposed on the first side of the upper portion of the main body. In certain embodiments, in a storage configuration, the top strap can be disposed inside the second pocket. In certain embodiments, the fixed end of the top strap can attach to the main body inside the second pocket.

In certain embodiments, an axis through the fixed end of the top strap and the second attachment point is perpendicular to an axis along the length of the main body. In certain embodiments, in the first configuration, an object secured by the top strap and the bottom strap can be disposed generally parallel to an axis along the length of the main body. In certain embodiments, in the second configuration, an object secured by the top strap and the bottom strap can be disposed along an axis oblique to an axis along the length of the main body.

In certain embodiments, the carrying pack can include two shoulder straps attached to the rear portion of the carrying pack. In certain embodiments, the attachment element can have a first end having a hole for attaching the bottom strap or the top strap to the attachment element and a second end having a hook configured to secure the attachment element to one of the plurality of loops of the first strap or the second strap or the first or second attachment point.

In certain embodiments, an adjustable carrying pack includes a main body having an outer surface with an upper portion, a lower portion, and a rear portion. The carrying pack can include a first strap having a plurality of loops disposed lengthwise along a first side of the outer surface of the main body and a second strap having a plurality of loops disposed lengthwise along a second side of the outer surface of the main body. In certain embodiments, the carrying pack can include a top strap having a fixed end and a free end having an attachment element. In certain embodiments, the fixed end can be attached on the first side of the upper portion of the main body. The carrying pack can also include a bottom strap having a fixed end and a free end having an attachment element, where the fixed end can be attached on the second side of the lower portion of the main body. In certain embodiments, the carrying pack can include a first pocket disposed on the second side of the lower portion of the main body and a second pocket disposed on the first side of the upper portion of the main body. In certain embodiments, the carrying pack can include a first attachment point disposed on the first side of the upper portion of the main body and a second attachment point disposed on the second side of the upper portion of the main body. In certain embodiments, in a first configuration, the attachment element of the bottom strap can attach to a loop of the first strap and the attachment element of the top strap can attach to the second attachment point. In certain embodiments, in a second configuration, the attachment element of the bottom strap can attach to a loop of the second strap and the attachment element of the top strap can attach to the first attachment point. In certain embodiments, in a storage configuration, the bottom strap can be disposed inside the first pocket and the top strap can be disposed inside the second pocket. In certain embodiments, the carrying pack also includes a first passage disposed along the first side of the lower portion of the main body and a second passage disposed along the second side of the lower portion of the main body. In certain embodiments, in the first configuration, the bottom strap can pass through the first passage, and in the second configuration, the bottom strap can pass through the second passage.

In certain embodiments, a backpack for securing an object in multiple configurations includes a first securing system, which can include a bottom strap having an attachment element, a first strap disposed on a first side of the backpack, and a second strap disposed on a second side of the backpack. The backpack can also include a second securing system, which can include a top strap having an attachment element, a first attachment point disposed on the first side of the backpack, and a second attachment point disposed on the second side of the backpack. In certain embodiments, in a first securing configuration, the object is secured by passing the bottom strap over the object and securing the attachment element of the bottom strap to the first strap and passing the top strap over the object and securing the attachment element of the top strap to the second attachment point. In certain embodiments, in a second securing configuration, the object is secured by passing the bottom strap around the object and securing the attachment element of the bottom strap to the second strap and passing the top strap around the object and securing the attachment element of the top strap to the first attachment point.

BRIEF DESCRIPTION OF THE DRAWINGS/FIGURES

The accompanying drawings, which are incorporated herein and form a part of the specification, illustrate the embodiments and, together with the description, further serve to explain the principles of the embodiments and to enable a person skilled in the relevant art(s) to make and use the embodiments.

Figure 1:
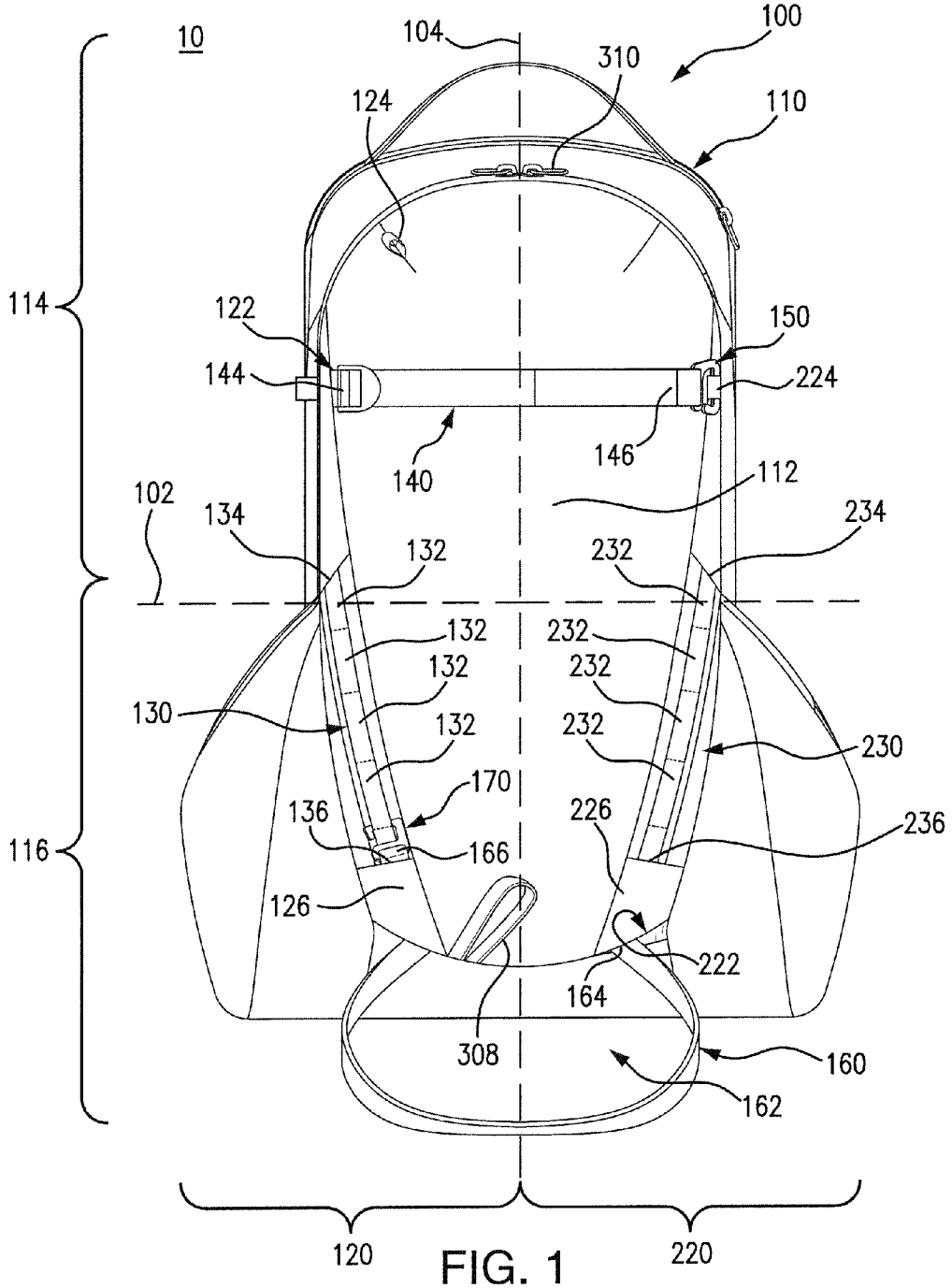
FIG. 1 illustrates a carrying pack in a first carrying configuration according to an embodiment.

The features and advantages of the embodiments will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

The present invention will now be described in detail with reference to embodiments thereof as illustrated in the accompanying drawings. References to "one embodiment," "an embodiment," "some embodiments," "certain embodiments", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

Figure 2:
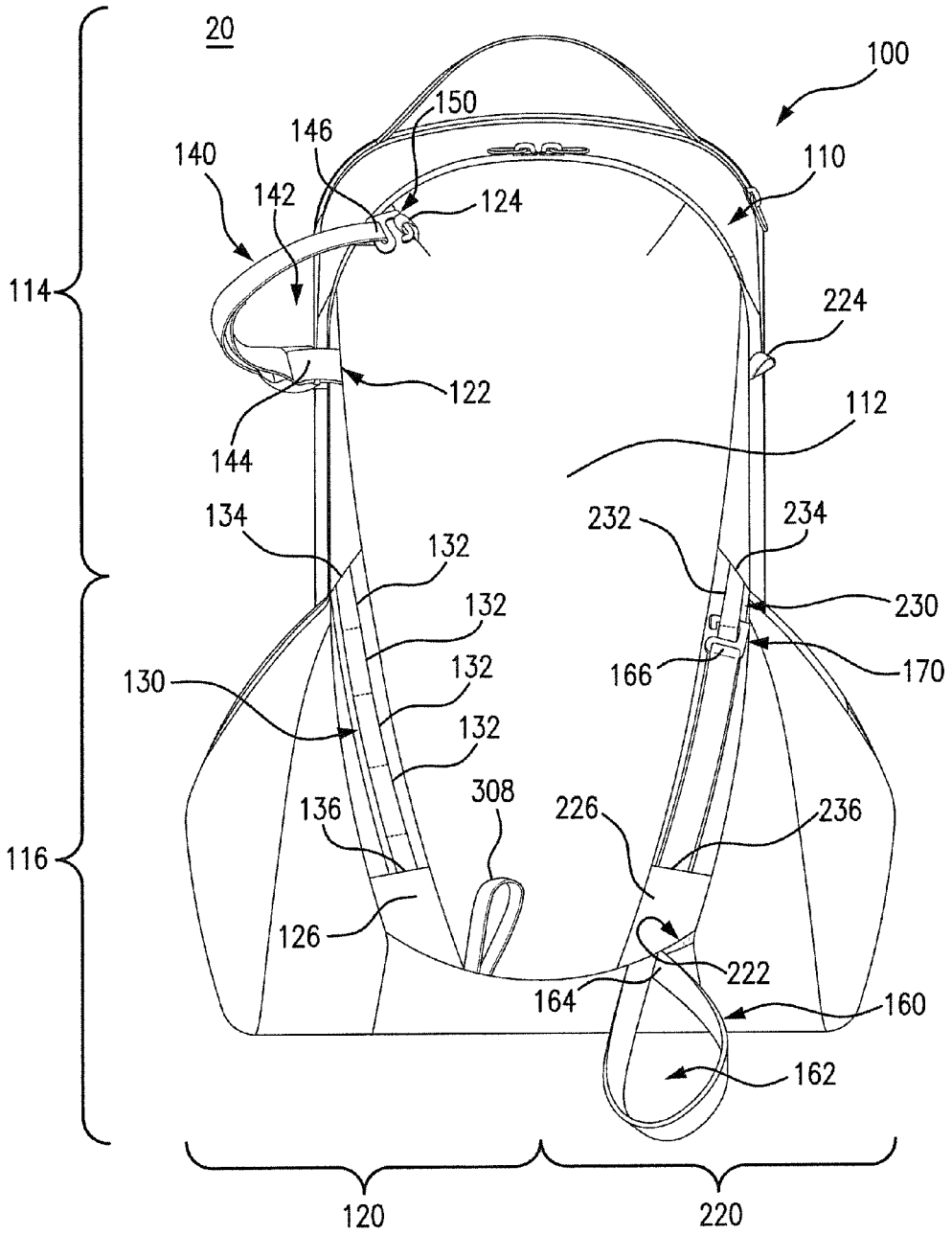
FIG. 2 illustrates a carrying pack in a second carrying configuration according to an embodiment.
Figure 3:
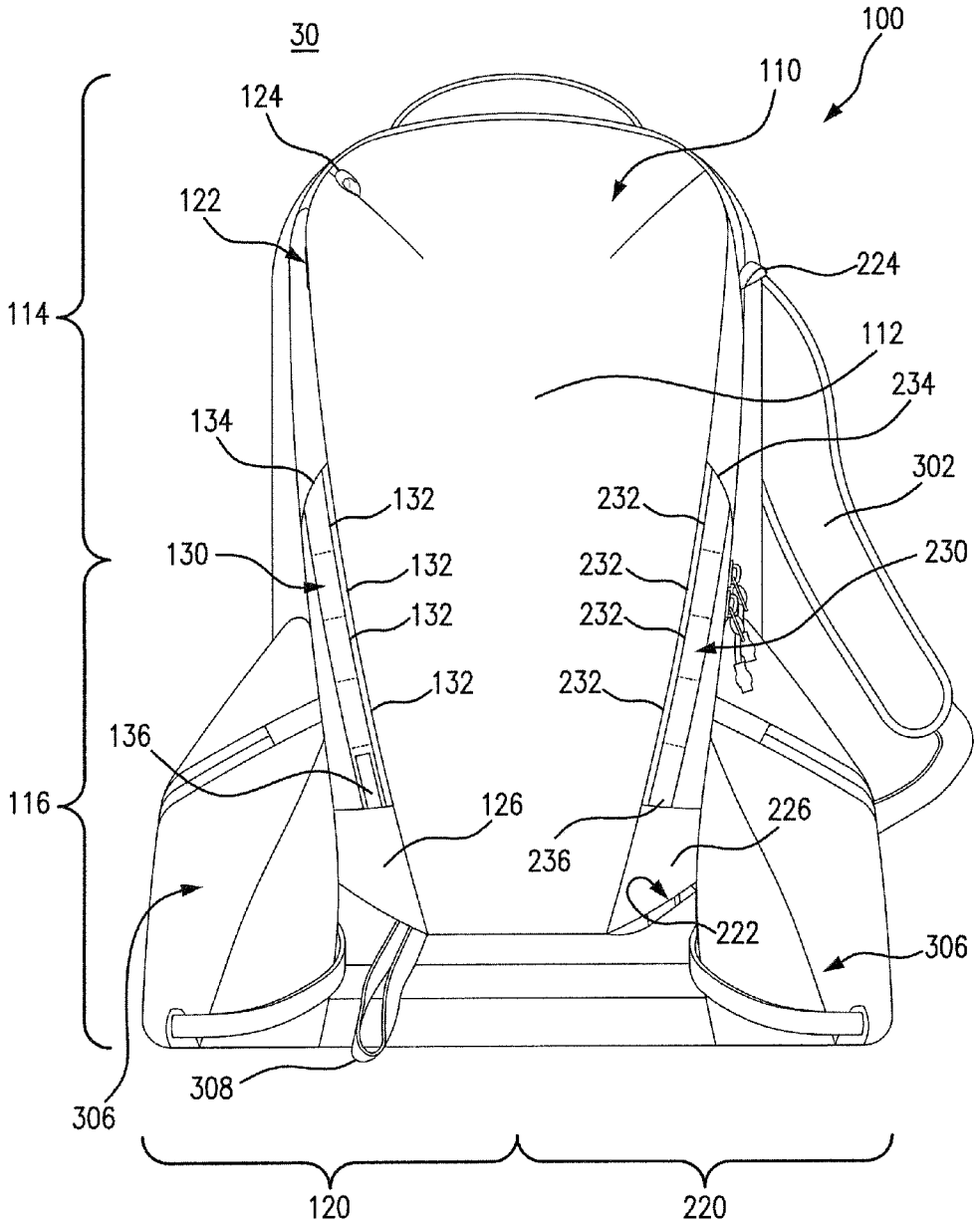
FIG. 3 illustrates a carrying pack in a storage configuration according to an embodiment.

FIGS. 1-3 illustrate a carrying pack in a first configuration 10, a second configuration 20, and a storage configuration 30, respectively, according to embodiments. Although generally referred to herein as a "carrying pack", carrying pack 100 can be other storage devices, for example, but not limited to, bags, backpacks, or similar articles. The straps of carrying pack 100 can be easily manipulated in order to switch the configuration of carrying pack 100.

Some backpacks are designed to carry specific types of equipment. For example, some backpacks are designed for carrying winter sports equipment such as skis or snowboards. Some backpacks are designed specifically to carry skis and other backpacks are designed specifically to carry snowboards. Some backpacks are adjustable and can carry either skis or a snowboard. However, these adjustable backpacks typically have complex designs requiring numerous straps and buckles. These straps are left exposed on the exterior of the backpack even when not in use. This creates a hazard because the straps can get caught or snagged, for example, on a ski lift chair or on tree branches. Damage to the backpack or injury to the user can result.

As described in further detail herein, embodiments of the carrying pack 100 provide one or more advantages over other types of packs, backpacks, and bags. For example, the carrying packs disclosed herein provide unique designs that allow the configuration of the straps to be quickly and easily adjusted for carrying different equipment. The user can quickly change the carrying configuration, for example, from carrying skis to carrying a snowboard and vice versa. And, if not carrying equipment, the straps can be stored away in pockets.

By way of example, as shown in FIG. 1, in a first configuration 10, carrying pack 100 can carry a snowboard by having top strap 140 attach to attachment point 224 and bottom strap 160 attach to a loop 132 of first strap 130. Carrying pack 100 can be quickly and easily switched to a second configuration 20, for example, for carrying skis, as shown in FIG. 2, by having top strap 140 attach to attachment point 124 and bottom strap 160 attach to a loop 232 of second strap 230. The length of top strap 140 can be adjustable to securely fasten the equipment. Having multiple loops 132 and 232 along first strap 130 and second strap 230, respectively, can allow the attachment location of bottom strap 160 to be adjusted, which also helps securely fasten the equipment.

The carrying pack 100 can also have a storage configuration 30, for example, as shown in FIG. 3. The top strap 140 and the bottom strap 160 can be placed inside pockets 122 and 222, respectively, to hide the straps. This can help prevent injuries to the user and damage to the carrying pack by reducing the chance of snagging the straps, for example, on a ski lift chair or on tree branches. It also provides a clean, sleek aesthetic to the exterior of the carrying pack 100 by hiding the straps when not in use. In certain embodiments, the pockets 122, 222 can be open to provide easy access to the straps. In some embodiments, the pockets 122, 222 can have a closure mechanism, for example, a zipper, snap, button, etc. to prevent the straps from falling out.

Referring now specifically to the drawings, FIG. 1 illustrates carrying pack 100 in a first configuration 10 according to an embodiment. In certain embodiments, first configuration 10 can be used to carry a snowboard. In configuration 10, the equipment secured to carrying pack 100 is disposed generally parallel to longitudinal midpoint line 104 between the sides 120, 220 of carrying pack 100 or along the width of the pack.

Figure 8:
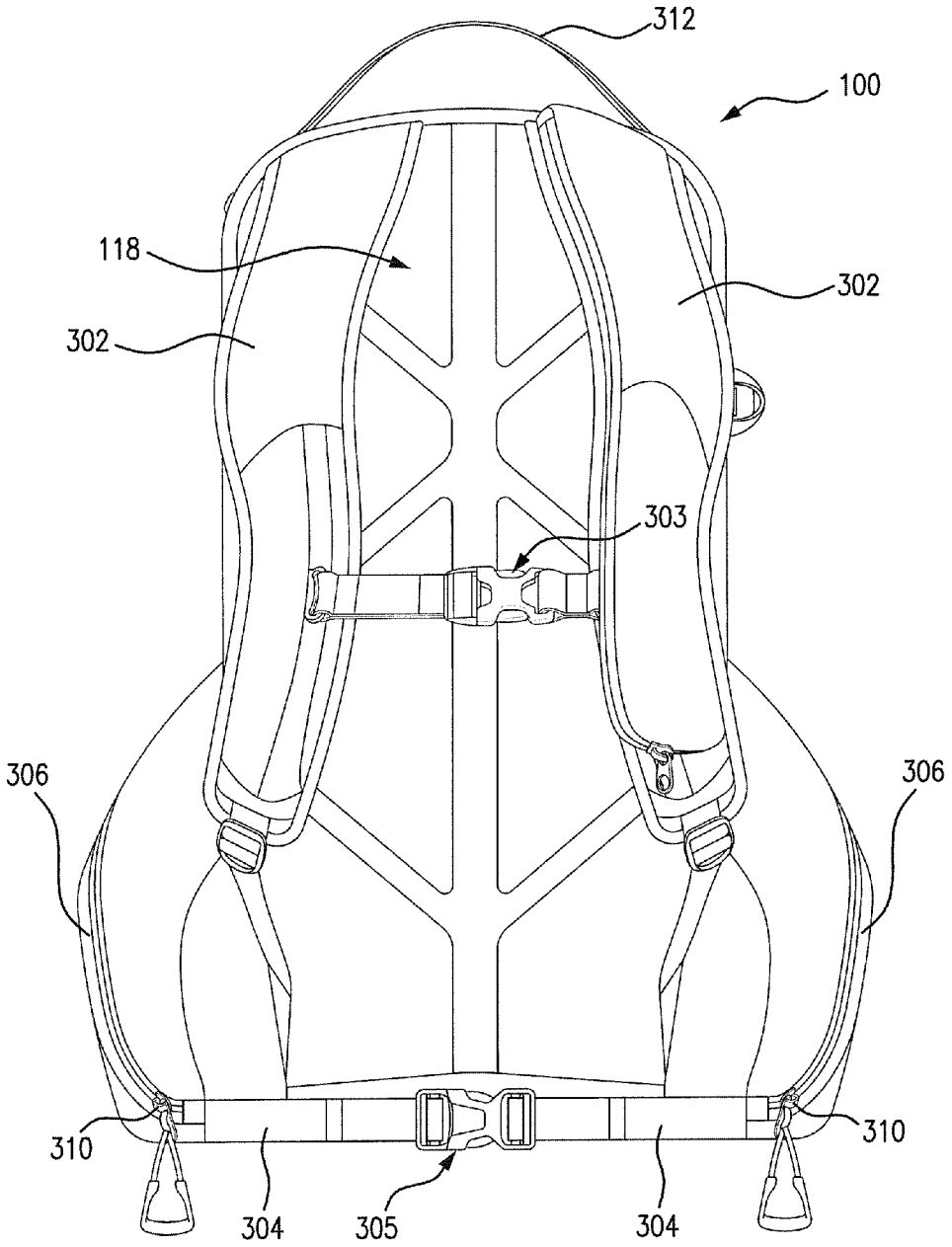
FIG. 8 illustrates a rear view of a carrying pack according to an embodiment.

Carrying pack 100 can include main body 110 having an outer surface 112, an upper portion 114, a lower portion 116, and a rear portion 118 (see e.g. FIG. 8). Main body 110 can be made of materials typically used for backpacks and bags, for example, but not limited to, polyester, nylon, canvas, woven or non-woven fabrics, synthetic materials, composite materials, or any combination thereof. In certain embodiments, upper portion 114 can be an upper half of carrying pack 100 and lower portion 116 can be a lower half of carrying pack 100. For example, in certain embodiments, upper portion 114 can be the part of carrying pack 100 above a latitudinal midpoint line 102 along the length of carrying pack 100 and lower portion 116 can be the part of carrying pack 100 below the latitudinal midpoint line 102. In certain embodiments, the outer surface 112 can include all exposed surface area of main body 110 and/or surfaces covered by other components, for example, the surface under passages 126 and 226 and the surface inside pockets 122 and 222.

In certain embodiments, carrying pack 100 can have one or more straps disposed on outer surface 112 of the main body 110. For example, carrying pack 100 can have first strap 130 and second strap 230 disposed along outer surface 112 of the main body 110. Additional straps can be included. The straps can be made from various materials. For example, the straps can be a woven fabric or a webbed material. In certain embodiments, the straps can be plastic.

In certain embodiments, first strap 130 can be disposed along a first side 120 of the main body 110 and second strap 230 can be disposed along a second side 220 of the main body 110. In certain embodiments, first side 120 can be a left half of main body 110 and second side 220 can be a right half of main body 110. For example, first side 120 can be the portion of main body 110 to the left of a longitudinal midpoint line 104 extending along the length of carrying pack 100 and second side 220 can be the portion of main body 110 to the right of the longitudinal midpoint line 104. In other embodiments, first side 120 can be the right half of main body 110 and second side 220 can be the left half of main body 110.

In certain embodiments, first strap 130 and second strap 230 can be disposed along a lengthwise direction of carrying pack 100. In certain embodiments, first strap 130 and second strap 230 can extend from the lower portion 116 to the upper portion 114 of main body 110. In certain embodiments, first strap 130 and second strap 230 can be parallel. In certain embodiments, first strap 130 and second strap 230 can be parallel to longitudinal midpoint line 104. In certain embodiments, first strap 130 and second strap 230 can be disposed at an angle with respect to each other such that upper ends of the straps are farther apart than lower ends of the straps. In certain embodiments, first strap 130 and second strap 230 can be disposed at an angle that is not parallel to longitudinal midpoint line 104.

In certain embodiments, first strap 130 can have one or more loops 132. First strap 130 can have an upper end 134 and a lower end 136. The loops 132 can be between upper end 134 and lower end 136. Similarly, in certain embodiments, second strap 230 can have one or more loops 232, an upper end 234, and a lower end 236. In certain embodiments, loops 132 of first strap 130 and loops 232 of second strap 230 can be created by stitches along the straps, attaching the straps to main body 110 of carrying pack 100. For example, the upper and lower ends of the straps can be attached to the main body 110, and stitches disposed across the width of the straps can create the loops along the length of the straps. The loops can be equal in size or they can be different sizes. The number of loops 132, 232 of first strap 130 and second strap 230 can vary. For example, there may be one, two, three, four, or five loops. There can also be more than five loops. In certain embodiments, first strap 130 can have more or fewer loops than second strap 230.

In certain embodiments, first side 120 of main body 110 can have a pocket 122, a first attachment point 124, and a first passage 126. Similarly, in certain embodiments, second side 220 of main body 110 can have a pocket 222, a second attachment point 224, and a second passage 226.

Figure 4:
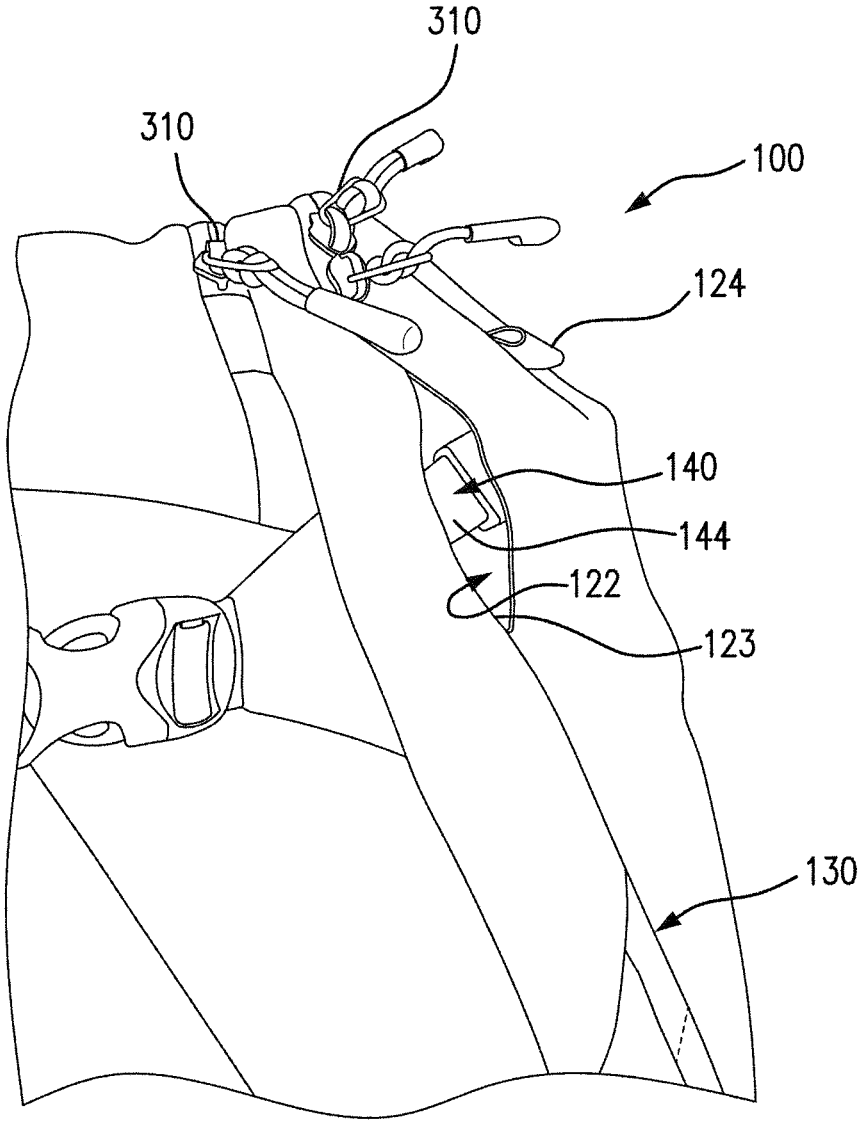
FIG. 4 illustrates a pocket of a carrying pack according to an embodiment.

Pockets 122 and 222 can be used to store top strap 140 and bottom strap 160, respectively, as shown for example, in FIGS. 3 and 4. In certain embodiments, pockets 122, 222 can be a pouch within main body 110 having an inner lining and an opening along outer surface 112 of main body 110. Generally, pockets 122, 222 are large enough to fit all of top strap 140 or bottom strap 160 inside so that the strap is not visible from the exterior of carrying pack 100 when disposed in the pocket. In certain embodiments, pockets 122, 222 can have a closure mechanism, for example, a zipper, snap, button, or hook-and-loop closure. This can prevent the straps from falling out of the pocket. In certain embodiments, the opening to pockets 122, 222 does not have a closure mechanism in order to facilitate easy access to the straps and reduce the number of exterior components on outer surface 112 of carrying pack 100.

First passage 126 and second passage 226 can facilitate forming loop 162 of bottom strap 160, as described in more detail below. In certain embodiments, first passage 126 and second passage 226 can be pieces of material attached to main body 110 to form tunnel-like passages. In certain embodiments, passages 126, 226 can be the same material as main body 110. In certain embodiments, passages 126, 226 can be formed by cutting slits in outer surface 112 of main body 110. In certain embodiments, passages 126, 226 can be disposed at lower ends 136, 236 of first strap 130 and second strap 230, respectively. In certain embodiments, first strap 130 and second strap 230 can extend within first passage 126 and second passage 226, respectively, such that the lower ends 136, 236 of first strap 130 and second strap 230 are attached to main body 110 within first passage 126 and second passage 226.

Attachment points 124, 224 can be used to attach a free end 146 of top strap 140 to main body 110 of carrying pack 100. In certain embodiments, attachment points 124, 224 can be loops or tabs of material attached to main body 110. The loops can be used to attach a hook 178 of an attachment element 150 at the free end 146 of top strap 140, which is described in further detail with respect to FIG. 9. In certain embodiments, attachment points 124, 224 can be part of other attachment devices, for example, buckles, snaps, or buttons. Attachment points 124, 224 can be disposed at various locations. In certain embodiments, attachment points 124, 224 are both disposed on upper portion 114 of main body 110. In certain embodiments, attachment point 124 is disposed farther from latitudinal midpoint line 102 than attachment point 224. In certain embodiments, attachment point 124 is disposed closer to longitudinal midpoint line 104 than attachment point 224.

In certain embodiments, carrying pack 100 can have a bottom strap 160. Bottom strap 160 can be made from any material, for example, a woven fabric or a webbed material. Bottom strap 160 can have a fixed end 164 and a free end 166. In certain embodiments, attachment element 170 can be attached to free end 166 of bottom strap 160. In certain embodiments, fixed end 164 of bottom strap 160 can be attached to main body 110 inside pocket 222. As shown in the embodiment in FIG. 1, bottom strap 160 can extend out of pocket 222, pass through first passage 126, and attachment element 170 of bottom strap 160 can attach to one of the loops 132 of first strap 130, forming loop 162 of bottom strap 160. In certain embodiments, bottom strap 160 can have an adjustable length. In certain embodiments, bottom strap 160 can be a fixed length.

In the embodiment shown in FIG. 1, loop 162 extends from second side 220, across longitudinal midpoint line 104, to first side 120 of main body 110. This loop 162 can secure equipment to carrying pack 100. The size of loop 162 can be adjusted by changing which loop 132 of first strap 130 that the attachment element 170 of bottom strap 160 is attached to. For example, attaching attachment element 170 of bottom strap 160 to a loop 132 of first strap 130 that is closer to upper portion 114 of main body 110 can make the size of loop 162 smaller. Detaching attachment element 170 from first strap 130 can release an object being secured to carrying pack 100 by bottom strap 160.

In certain embodiments, carrying pack 100 can include top strap 140. Top strap 140 can be made from any material, for example, a woven fabric or a webbed material. Top strap 140 can have a fixed end 144 and a free end 146. In certain embodiments, attachment element 150 can be attached to free end 146 of top strap 140. In certain embodiments, fixed end 144 of top strap 140 can be attached directly to main body 110 of carrying pack 100. In certain embodiments, fixed end 144 of top strap 140 can be attached to main body 110 inside pocket 122. As shown in the embodiment in FIG. 1, attachment element 150 of top strap 140 can be attached to attachment point 224 of main body 110. In certain embodiments, fixed end 144 of top strap 140 can be attached on a first side 120 of main body 110 and attachment point 224 can be disposed on a second side 220 of main body 110. In certain embodiments, a line through attachment point 224 and the fixed end 144 of top strap 140 can be perpendicular to longitudinal midpoint line 104. In certain embodiments, the length of top strap 140 can be adjustable in order to increase or decrease the size of loop 142 of top strap 140 to secure equipment to carrying pack 100. In certain embodiments, top strap 140 can be a fixed length.

FIG. 2 illustrates carrying pack 100 in a second configuration 20 according to an embodiment. In certain embodiments, second configuration 20 can be used to carry skis on carrying pack 100. In configuration 20 shown in FIG. 2, the equipment secured to carrying pack 100 is generally disposed at an oblique angle with respect to longitudinal midpoint line 104. In certain embodiments, the angle can be greater than 10 degrees. In certain embodiments, the angle can be approximately 45 degrees.

The components of carrying pack 100 in the embodiment shown in FIG. 2 are the same as those in the embodiment shown in FIG. 1, however, the attachment configurations of bottom strap 160 and top strap 140 are different. As shown in FIG. 2, in an embodiment, bottom strap 160 can extend out of pocket 222, through second passage 226, and attachment element 170 of bottom strap 160 can attach to one of the loops 232 of second strap 230 on second side 220 of main body 110. In certain embodiments, loop 162 formed by bottom strap 160 can be disposed only on one side of main body 110, in this example, second side 220, without extending across longitudinal midpoint line 104. As in configuration 10, the size of loop 162 in configuration 20 can be adjusted by changing which loop 232 of second strap 230 that the attachment element 170 of bottom strap 160 is attached to. For example, attaching attachment element 170 of bottom strap 160 to a loop 232 of second strap 230 that is closer to upper portion 114 of main body 110 can make the size of loop 162 smaller. Detaching attachment element 170 from second strap 230 can release an object being secured to carrying pack 100 by bottom strap 160.

As also shown in FIG. 2, in an embodiment, attachment element 150 of top strap 140 can attach to first attachment point 124 on first side 120 of main body 110. In certain embodiments, attachment point 124 can be disposed higher on upper portion 114 of main body 110 than attachment point 224. As shown in FIG. 2, in certain embodiments, loop 162 formed by bottom strap 160 and loop 142 formed by top strap 140 can be smaller in the second configuration 20 in comparison to the first configuration 10 shown in FIG. 1. In certain embodiments, this can be accomplished by shortening top strap 140 using an adjustment mechanism. In the embodiment shown in FIG. 2, a line between loop 162 of bottom strap 160 and loop 142 of top strap 140 is disposed at an angle with respect to the lengthwise direction of carrying pack 100, whereas in FIG. 1, a line between loop 162 and loop 142 is generally along the lengthwise direction of carrying pack 100.

FIG. 3 illustrates carrying pack 100 in a storage configuration 30 according to an embodiment. In certain embodiments, in storage configuration 30, one or both of top strap 140 and/or bottom strap 160 can be tucked into respective pockets 122 and 222. In certain embodiments, the entire strap, including the attachment element, can fit inside the pocket. This can prevent top strap 140 and bottom strap 160 from getting snagged when not in use carrying equipment, thereby reducing the risk of damage to carrying pack 100 and injury to the user. Further, reducing the number of exposed components of carrying pack 100 provides a cleaner, sleeker, and more stylish look to carrying pack 100. As also shown in FIG. 3, carrying pack 100 can have one or more shoulder strap 302.

FIG. 4 illustrates pocket 122 of carrying pack 100 according to an embodiment. As shown in FIG. 4, top strap 140 can be tucked inside pocket 122, for example, when in storage configuration 30. As shown in FIG. 4, the opening of pocket 122 can be along a seam 123, making the opening discreet as viewed from the exterior of carrying pack 100. In certain embodiments, fixed end 144 of top strap 140 can be attached to main body 110 inside pocket 122. In certain embodiments, fixed end 144 of top strap 140 can be attached to main body 110 outside of pocket 122. In certain embodiments, fixed end 144 of top strap 140 can be attached to main body 110 along seam 123 of pocket 122.

Figure 5:
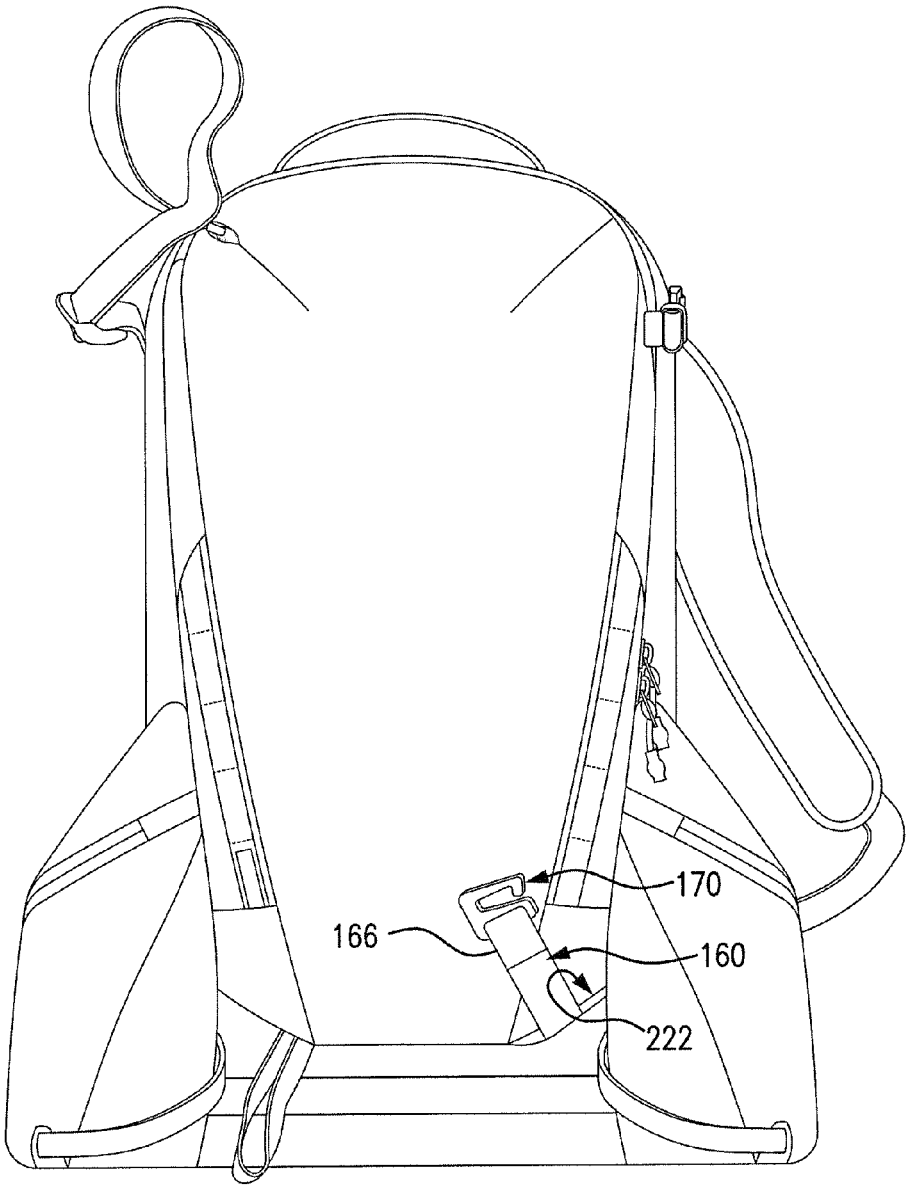
FIG. 5 illustrates a strap of a carrying pack partially extending from a pocket according to an embodiment.
Figure 6:
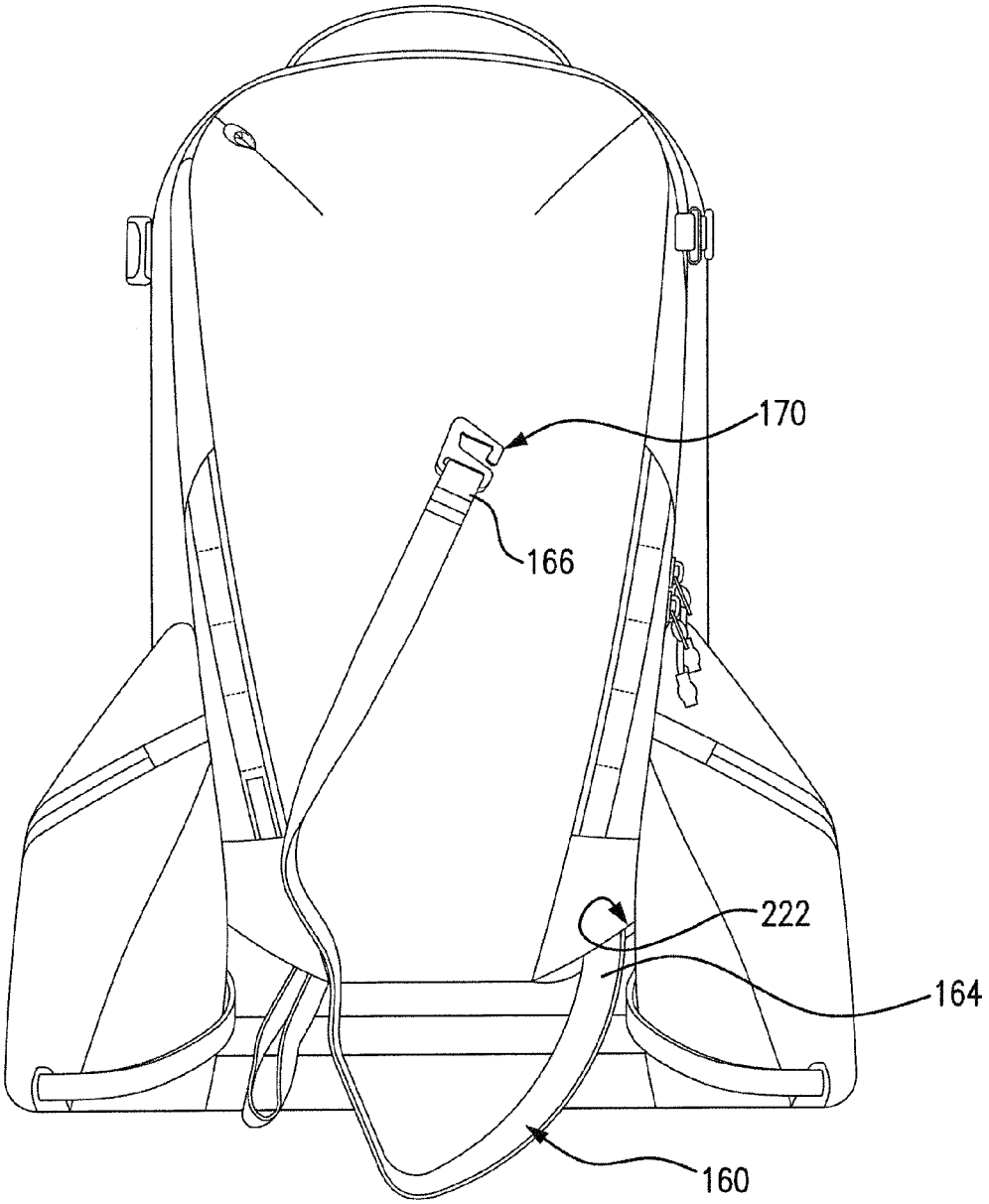
FIG. 6 illustrates a strap of a carrying pack fully extending from a pocket according to an embodiment.

Although FIG. 4 illustrates pocket 122, the features described herein can also relate to pocket 222, and therefore bottom strap 160, as well. For example, bottom strap 160 can similarly be attached to main body 110 inside of pocket 222, outside of pocket 222, or along a seam of pocket 222. As shown in FIG. 5, bottom strap 160 can be pulled out of pocket 222. FIG. 5 illustrates part of free end 166 with attachment element 170 of bottom strap 160 extending from pocket 222. FIG. 6 illustrates where bottom strap 160 is pulled entirely out of pocket 222. In FIG. 6, fixed end 164 of bottom strap 160 is attached to main body 110 inside of pocket 222. However, fixed end 164 of bottom strap 160 can also be attached to main body 110 outside of pocket 222.

Figure 7:
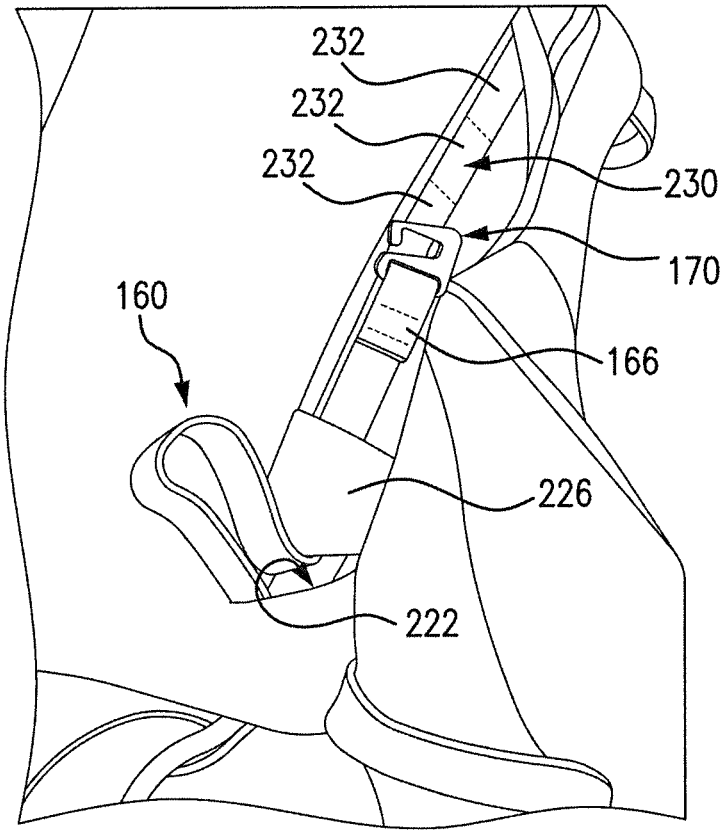
FIG. 7 illustrates a strap of a carrying pack extending through a channel according to an embodiment.

FIG. 7 illustrates bottom strap 160 being fed through second passage 226 according to an embodiment. For example, bottom strap 160 can be fed through second passage 226 in this manner in order to create the second configuration 20 shown in FIG. 2. Once attachment element 170 of bottom strap 160 is fed through second passage 226, attachment element 170 can then be attached to one of the loops 232 of second strap 230. This will place bottom strap 160 in the second configuration 20 shown in FIG. 2. Similarly, attachment element 170 of bottom strap 160 can be fed through first passage 126 and then attached to one of the loops 132 of first strap 130 to place bottom strap 160 in the first configuration 10 shown in FIG. 1. In certain embodiments, attachment element 170 can be attached directly to one of the loops 232 of second strap 230 without passing through second passage 226. Similarly, in certain embodiments, attachment element 170 can be attached directly to one of the loops 132 of first strap 130 without passing through first passage 126.

FIG. 8 illustrates a rear view of carrying pack 100 according to an embodiment. As shown in FIG. 8, rear portion 118 of carrying pack 100 can have one or more shoulder straps 302. In certain embodiments, shoulder straps 302 can be connected to each other, for example, using buckle 303. In certain embodiments, carrying pack 100 can have waist straps 304, which can be connected, for example, by buckle 305. In certain embodiments, rear portion 118 is a different material than upper portion 114 and lower portion 116. For example, in certain embodiments, rear portion 118 can be cushioned or padded to provide comfort against the user's back.

Embodiments of carrying pack 100 can include additional features and components. For example, carrying pack can include loop 308 (see FIG. 1), which can be used for carrying equipment such as an ice pick. Carrying pack 100 can also include one or more side pocket 306 (see FIG. 3). Zippers 310 can be used for opening and closing compartments of carrying pack 100 (see FIG. 4). In certain embodiments, carrying pack 100 can include a carry handle 312 located, for example, on upper portion 114.

Figure 9:
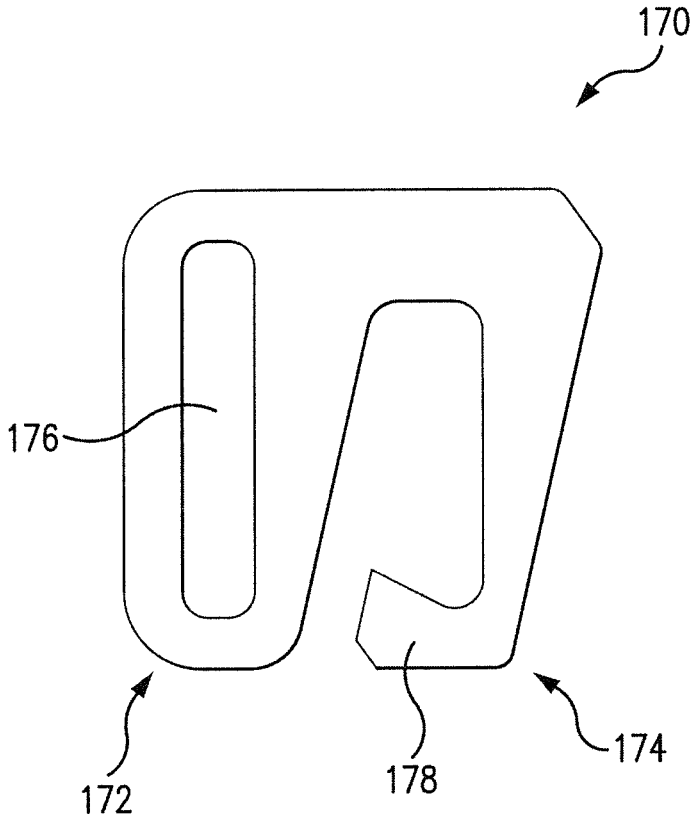
FIG. 9 illustrates an attachment element of a strap for a carrying pack according to an embodiment.

FIG. 9 illustrates an attachment element according to an embodiment. The attachment element can be used, for example, as the attachment element 150 of top strap 140 and/or the attachment element 170 of bottom strap 160. FIG. 9 specifically shows an embodiment of attachment element 170 of bottom strap 160. In certain embodiments, attachment element 170 can have first end 172 and second end 174. In certain embodiments, first end 172 can have a hole 176. Bottom strap 160 can extend through hole 176 to attach bottom strap 160 and attachment element 170. For example, bottom strap 160 can be fed through hole 176, doubled over, and then bottom strap 160 can be stitched to itself. In certain embodiments, attachment element 170 can have a hook 178 at second end 174. Hook 178 can be used to connect attachment element 170 of bottom strap 160 to one of the loops 132 of first strap 130 or one of the loops 232 of second strap 230. Similarly, a hook of attachment element 150 can attach top strap 140 to attachment points 124, 224. Other sizes, shapes and configurations of attachment element 170 are contemplated. For example, attachment elements can be buckles, clasps, snaps, etc. having corresponding fastening mechanisms on straps 130, 230 and/or attachment points 124, 224.

Figure 10:
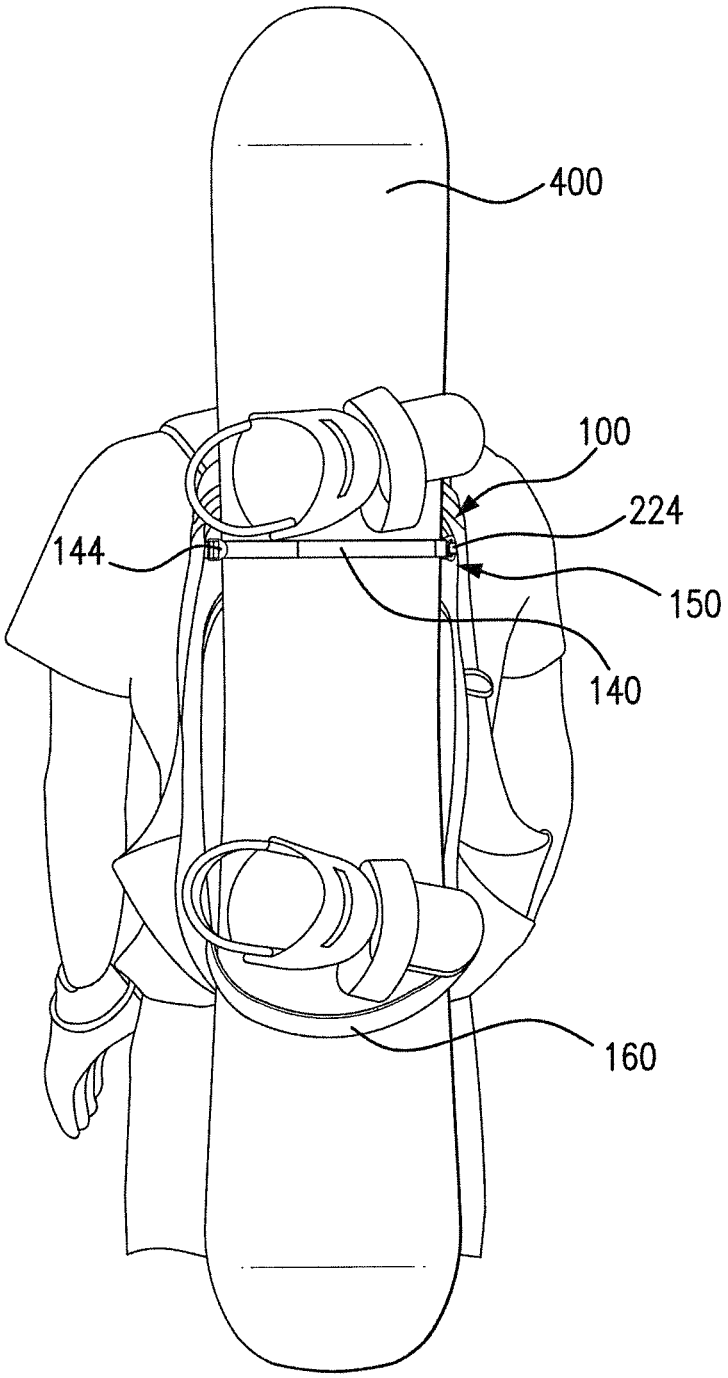
FIG. 10 illustrates a carrying pack holding a snowboard in a first carrying configuration according to an embodiment.

FIG. 10 illustrates carrying pack 100 in use carrying a snowboard 400 according to an embodiment. In the embodiment shown in FIG. 10, carrying pack 100 is in first configuration 10. Bottom strap 160 extends from pocket 222, passes over the snowboard 400, passes through first passage 126, and attachment element 170 is attached to a loop 132 of first strap 130. Top strap 140 extends from fixed end 144, passes over snowboard 400, and attachment element 150 is attached to attachment point 224. In the embodiment shown in FIG. 10, snowboard 400 is generally parallel to the lengthwise direction of carrying pack 100.

Figure 11:
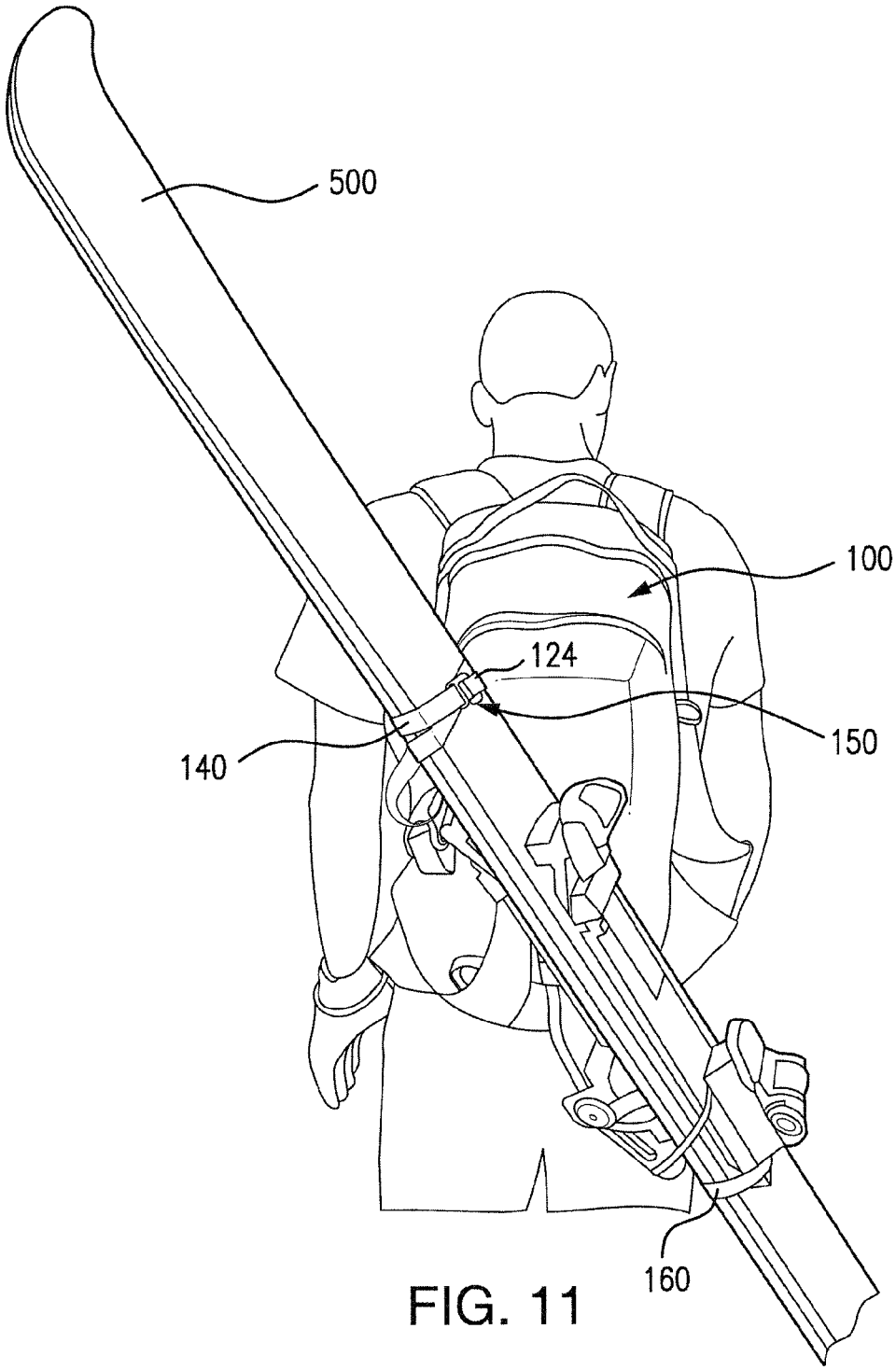
FIG. 11 illustrates a carrying pack holding skis in a second carrying configuration according to an embodiment.

FIG. 11 shows carrying pack 100 carrying skis 500 according to an embodiment. In the embodiment shown in FIG. 11, carrying pack 100 is in second configuration 20. Bottom strap 160 extends from pocket 222, wraps around the skis 500, passes through second passage 226, and attachment element 170 is attached to a loop 232 of second strap 230. Top strap 140 extends from fixed end 144, passes around skis 500, and attachment element 150 is attached to attachment point 124. As shown in FIG. 11, skis 500 are oriented at an angle with respect to the lengthwise direction of carrying pack 100.

It will be appreciated that other methods of securing equipment to carrying pack 100 are possible beyond the examples shown in FIGS. 10 and 11 and specifically described herein and that the user can adjust the carrying pack 100 from one configuration to another. For example, in certain embodiments, top strap 140 and/or bottom strap 160 can be passed through features of the equipment being carried. For example, the straps can pass through bindings on a snowboard or skis to help secure the equipment to carrying pack 100. In certain embodiments, top strap 140 and/or bottom strap 160 can be wrapped around the equipment multiple times. For example, bottom strap 160 can be wrapped around skis several times before being fed through second passage 226 and then attached to second strap 230. In certain embodiments, bindings of a snowboard or skis can rest on top strap 140 and/or bottom strap 160.

It is to be appreciated that the Detailed Description section, and not the Brief Summary and Abstract sections, is intended to be used to interpret the claims. The Summary and Abstract sections may set forth one or more but not all exemplary embodiments of adjustable carrying packs as contemplated by the inventors, and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An adjustable carrying pack, comprising:

a main body defining a storage compartment and comprising an outer surface having an upper portion, a lower portion, and a rear portion;

at least one shoulder strap attached to the main body;

a first strap disposed along a first side of the outer surface of the main body, the first strap being elongated in a lengthwise direction of the main body, wherein the first strap is attached to the outer surface of the main body at a plurality of locations forming a plurality of loops along the first strap;

a second strap along a second side of the outer surface of the main body, the second strap being elongated in the lengthwise direction of the main body, wherein the second strap is attached to the outer surface of the main body at a plurality of locations forming a plurality of loops along the second strap;

a bottom strap comprising a fixed end and a free end having an attachment element, wherein the fixed end is attached on the second side of the lower portion of the main body;

a first elongated passage elongated in the lengthwise direction of the main body and disposed along the first side of the lower portion of the main body; and a second elongated passage elongated in the lengthwise direction of the main body and disposed along the second side of the lower portion of the main body, wherein in a first configuration a bottom strap loop is formed by passing the bottom strap through the first elongated passage in the lengthwise direction and attaching the attachment element of the bottom strap to a loop of the first strap, and wherein in a second configuration the bottom strap loop is formed by passing the bottom strap through the second elongated passage in the lengthwise direction and attaching the attachment element of the bottom strap to a loop of the second strap.

2. The adjustable carrying pack of claim 1, wherein lower ends of the first and second straps attach to the main body within the respective first and second elongated passages.

3. The adjustable carrying pack of claim 1, wherein the bottom strap loop in the first configuration is larger than the bottom strap loop in the second configuration.

4. The adjustable carrying pack of claim 1, wherein the attachment element comprises a first end having a hole for attaching the bottom strap to the attachment element and a second end having a hook configured to secure the attachment element to one of the plurality of loops of the first strap or the second strap.

5. The adjustable carrying pack of claim 1, further comprising a first pocket disposed on the second side of the lower portion of the main body, wherein in a storage configuration the bottom strap is disposed inside the first pocket.

6. The adjustable carrying pack of claim 5, wherein the fixed end of the bottom strap is attached to the main body inside the first pocket.

7. The adjustable carrying pack of claim 1, wherein the first and second straps extend from the lower portion of the main body to the upper portion of the main body.

8. The adjustable carrying pack of claim 1, wherein the first and second straps are parallel.

9. The adjustable carrying pack of claim 1, wherein the first and second straps are disposed at an angle with respect to each other such that upper ends of the first and second straps are farther apart than lower ends of the first and second straps.

10. The adjustable carrying pack of claim 1, further comprising:

a top strap comprising a fixed end and a free end having an attachment element, wherein the fixed end is attached on the first side of the upper portion of the main body;

a first attachment point disposed on the first side of the upper portion of the main body; and a second attachment point disposed on the second side of the upper portion of the main body, wherein in the first configuration a top strap loop is formed by attaching the attachment element of the top strap to the second attachment point, and wherein in the second configuration a top strap loop is formed by attaching the attachment element of the top strap to the first attachment point.

11. The adjustable carrying pack of claim 10, further comprising:

a first pocket disposed on the second side of the lower portion of the main body, wherein in a storage configuration the bottom strap is disposed inside the first pocket; and a second pocket disposed on the first side of the upper portion of the main body, wherein in a storage configuration the top strap is disposed inside the second pocket.

12. The adjustable carrying pack of claim 11, wherein the fixed end of the top strap is attached to the main body inside the second pocket.

13. The adjustable carrying pack of claim 10, wherein an axis through the fixed end of the top strap and the second attachment point is perpendicular to an axis along the length of the main body.

14. The adjustable carrying pack of claim 10, further comprising two shoulder straps attached to the rear portion of the carrying pack.

15. The adjustable carrying pack of claim 1, wherein a lower edge of the second passage is angled oblique to a longitudinal midpoint line of the main body.

16. The adjustable carrying pack of claim 1, wherein in the first configuration the bottom strap loop has an opening in a direction parallel to a longitudinal midpoint line of the main body, and wherein in the second configuration the bottom strap loop has an opening in a direction oblique to the longitudinal midpoint line of the main body.

17. The adjustable carrying pack of claim 10, wherein in the first configuration a longitudinal midpoint line intersects the bottom strap loop and the top strap loop, and wherein in the second configuration the bottom strap loop and the top strap loop are laterally offset on opposite sides of the longitudinal midpoint line.

18. An adjustable carrying pack, comprising:

a main body defining a storage compartment and comprising an outer surface having an upper portion, a lower portion, and a rear portion;

at least one shoulder strap attached to the main body;

a first strap disposed along a first side of the outer surface of the main body, wherein the first strap is attached to the outer surface of the main body at a plurality of locations forming a plurality of loops along the first strap;

a second strap along a second side of the outer surface of the main body, wherein the second strap is attached to the outer surface of the main body at a plurality of locations forming a plurality of loops along the second strap;

a bottom strap comprising a fixed end and a free end having an attachment element, wherein the fixed end is attached on the second side of the lower portion of the main body;

a first elongated passage extending in a lengthwise direction of the main body and disposed along the first side of the lower portion of the main body; and a second elongated passage extending in a lengthwise direction of the main body and disposed along the second side of the lower portion of the main body, wherein a lower end of the first strap attaches to the main body within the first elongated passage, wherein in a first configuration a bottom strap loop is formed by passing the bottom strap through the first elongated passage and attaching the attachment element of the bottom strap to a loop of the first strap, and wherein in a second configuration the bottom strap loop is formed by passing the bottom strap through the second elongated passage and attaching the attachment element of the bottom strap to a loop of the second strap.

19. The adjustable carrying pack of claim 18, wherein a lower end of the second strap attaches to the main body within the second elongated passage.

20. The adjustable carrying pack of claim 18, wherein the bottom strap loop in the first configuration is larger than the bottom strap loop in the second configuration.

21. The adjustable carrying pack of claim 18, further comprising a first pocket disposed on the second side of the lower portion of the main body, wherein in a storage configuration the bottom strap is disposed inside the first pocket.

22. The adjustable carrying pack of claim 18, further comprising:

a top strap comprising a fixed end and a free end having an attachment element, wherein the fixed end is attached on the first side of the upper portion of the main body;

a first attachment point disposed on the first side of the upper portion of the main body; and a second attachment point disposed on the second side of the upper portion of the main body, wherein in the first configuration a top strap loop is formed by attaching the attachment element of the top strap to the second attachment point, and wherein in the second configuration a top strap loop is formed by attaching the attachment element of the top strap to the first attachment point.

* * * * *